US006182318B1

(12) United States Patent
Roberts et al.

(10) Patent No.: US 6,182,318 B1
(45) Date of Patent: Feb. 6, 2001

(54) LIQUIFIED GAS DRY-CLEANING SYSTEM WITH PRESSURE VESSEL TEMPERATURE COMPENSATING COMPRESSOR

(75) Inventors: James L. Roberts, Green Lake; Andrew Kegler, Ripon, both of WI (US)

(73) Assignee: Alliance Laundry Systems LLC, Ripon, WI (US)

( * ) Notice: Under 35 U.S.C. 154(b), the term of this patent shall be extended for 0 days.

(21) Appl. No.: 09/213,550

(22) Filed: Dec. 17, 1998

Related U.S. Application Data

(62) Division of application No. 08/998,219, filed on Dec. 24, 1997, now Pat. No. 5,850,747.

(51) Int. Cl.[7] ..... D06B 11/26
(52) U.S. Cl. ..... 8/158; 8/159
(58) Field of Search ..... 68/15, 16, 18 R, 68/5 C; 8/158, 159

(56) References Cited

U.S. PATENT DOCUMENTS

| | | | | |
|---|---|---|---|---|
| 4,769,921 | * | 9/1988 | Kabakov et al. | 34/27 |
| 4,774,821 | * | 10/1988 | Luppi et al. | 68/18 |
| 4,800,655 | * | 1/1989 | Mori et al. | 34/77 |
| 4,817,296 | * | 4/1989 | Kabakov | 34/77 |
| 4,984,318 | * | 1/1991 | Condreau-Palau | 8/158 |
| 5,013,366 | * | 5/1991 | Jackson et al. | 134/1 |
| 5,123,207 | * | 6/1992 | Gillis, Jr. et al. | 51/426 |
| 5,195,252 | * | 3/1993 | Yamada et al. | 34/26 |
| 5,232,476 | * | 8/1993 | Grant | 55/42 |
| 5,316,591 | * | 5/1994 | Chao et al. | 134/34 |
| 5,339,844 | * | 8/1994 | Stanford, Jr. et al. | 134/107 |
| 5,370,740 | * | 12/1994 | Chao et al. | 134/1 |
| 5,456,759 | * | 10/1995 | Stanford, Jr. et al. | 134/1 |
| 5,467,492 | * | 11/1995 | Chao et al. | 8/159 |
| 5,482,211 | * | 1/1996 | Chao et al. | 239/135 |
| 5,498,266 | * | 3/1996 | Takagawa et al. | 8/142 |
| 5,651,276 | * | 7/1997 | Purer et al. | 68/5 C |
| 5,669,251 | * | 9/1997 | Townsend et al. | 68/58 |
| 5,822,818 | * | 10/1998 | Chao et al. | 8/158 |

* cited by examiner

*Primary Examiner*—Jill Warden
*Assistant Examiner*—Paul J. Lee
(74) *Attorney, Agent, or Firm*—Leydig, Voit & Mayer, Ltd.

(57) ABSTRACT

A liquified gas dry-cleaning system including a storage tank containing a liquified gas derived from a liquifiable gas, a pressure vessel for containing a liquid bath derived from the liquifiable gas, and a circulating system for transporting the liquified gas between the storage tank and the pressurized vessel. The pressurized vessel includes a compressor mounted in a wall structure of the vessel for use in evacuating a gaseous form of the liquifiable gas released from the liquid bath during a cleaning cycle. Positioning of the compressor in this manner allows heat generated during each compression stroke of the compressor to be directed to the interior of pressure vessel to minimize the effects of a temperature decrease incident to the gaseous evacuation.

3 Claims, 2 Drawing Sheets

LIQUIFIED GAS DRY-CLEANING SYSTEM WITH PRESSURE VESSEL TEMPERATURE COMPENSATING COMPRESSOR

This is a divisional of application Ser. No. 08/998,219, filed on Dec. 24, 1997, now U.S. Pat. No. 5,850,747.

FIELD OF THE INVENTION

The present invention relates to liquified gas dry-cleaning systems and, more particularly, to a liquified gas dry-cleaning system having means for minimizing temperature decreases within the pressure vessel cleaning chamber incident to evacuation of gases released during a dry-cleaning cycle.

BACKGROUND OF THE INVENTION

Known dry-cleaning processes consist of a wash, rinse, and drying/draining cycle with solvent recovery. During this process, items, such as garments, are loaded into a basket positioned within a vessel and immersed in a dry-cleaning solvent pumped into the vessel from a base tank. Conventional dry-cleaning solvents include perchloroethylene (PCE), petroleum-based or Stoddard solvents, CFC-113, and 1,1,1-trichloroethane, all of which are generally aided by a detergent. The use of these solvents, however, poses a number of health and safety risks as well as being environmentally hazardous.

To minimize these problems, dry-cleaning systems that use liquified gas as a cleaning medium, such as liquid carbon dioxide, have been developed. An example of such a cleaning system is found in U.S. Pat. No. 5,339,844 entitled "Low Cost Equipment For Cleaning Using Liquifiable Gas." This system includes a source of liquified gas, an enclosed pressure vessel that forms a cleaning chamber for containing items to be cleaned and a bath of the liquified gas, and a circulatory system for circulating the liquified gas between the source and the vessel. Additionally, as is typical of the prior art, the system utilizes a compressor in the circulatory system, positioned remotely from the pressure vessel, which is used to evacuate gaseous vapors in the vessel released during a cleaning cycle.

Such liquified gas dry-cleaning systems, however, have substantial disadvantages. For example, during the vapor recovery cycle of the dry-cleaning process, heat must be supplied to the vessel to prevent the interior temperature from descending below a prohibitively low level. In currently used systems, this heat is provided by electrical heat exchangers. However, the costs associated with operating these heat exchangers is relatively expensive and, as a result, undesirably diminishes the rate of return dry-cleaning operators can expect to receive. Additionally, the arrangement of using a separate compressor that is typically located 6–8 feet away from the vessel undesirably uses space that could be used, for example, to position another cleaning system. As such, it is seen that a need exists for an improved dry-cleaning system that addresses these problems.

OBJECTS AND SUMMARY OF THE INVENTION

It is a general object of the invention to provide an improved liquified gas dry-cleaning system that minimizes the costs associated with its operation.

Another object is to provide a dry-cleaning system as characterized above that requires relatively lesser space requirements when installed in a dry-cleaning establishment.

A further object is to provide an dry-cleaning system of the foregoing type in which the heat of compression associated with the evacuation of gaseous vapors from the cleaning chamber is utilized to directly offset temperature decreases incident to the gaseous evacuation. In this manner, the system may be operated with relative cost savings while also minimizing the overall spacial print of the dry-cleaning system.

Other objects and advantages of the invention will become apparent upon reading the following detailed description and upon reference to the drawings, in which:

Figure 1:
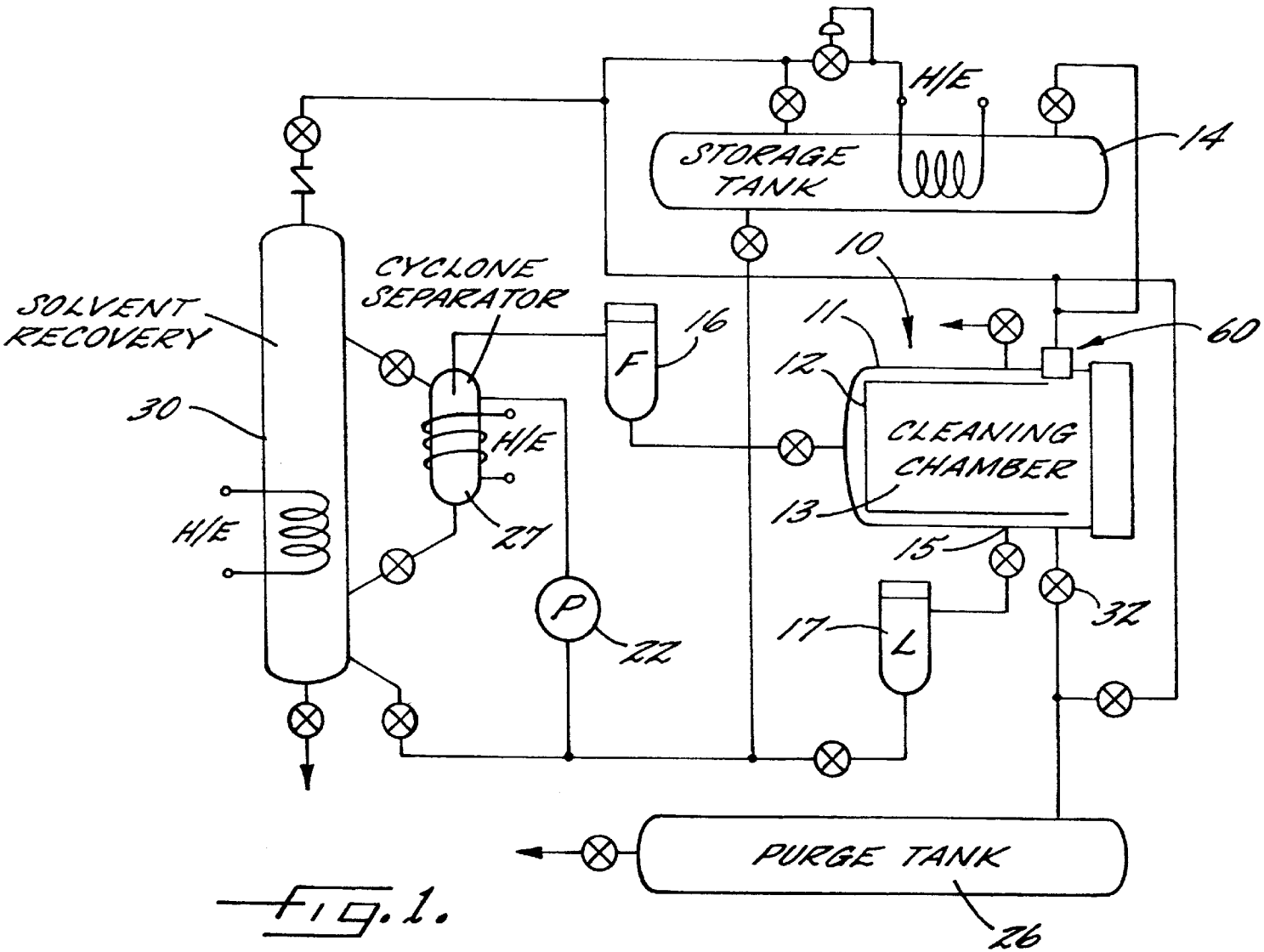
FIG. 1 is a schematic of a dry-cleaning system in accordance with the invention.

While the invention is susceptible of various modifications and alternative constructions, a certain illustrated embodiment thereof has been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE DRAWINGS

Referring now more particularly to FIG. 1, there is shown an illustrative dry-cleaning machine 10 embodying the present invention. The dry-cleaning machine 10 preferably utilizes liquified carbon dioxide as the dry-cleaning solvent, typical of U.S. Pat. Nos. 5,651,276, 5,467,492, and 5,651,276 the disclosures of which are incorporated herein by reference. Nevertheless, it will be appreciated that the invention described hereinafter may also be used in connection with other types of liquified gas dry-cleaning processes. Accordingly, the description that follows is not intended to be limiting.

In general, the dry-cleaning machine 10 includes a pressurize vessel 11 which defines a cleaning chamber 13 having a rotatable basket 12 supported therein for containing items to be cleaned, for example, garments. Liquified carbon dioxide used as the dry-cleaning solvent is directed into the vessel 11 from a pressurized storage tank 14 through inlet 15. As is known in the art, the vessel 11 may be further equipped with a pressure check valve, pressure sensor, and temperature sensor to aid in temperature and pressure control for maintaining the carbon dioxide in liquid phase during cleaning. Additionally, the dry-cleaning machine 10 includes a pressurizable purge tank 26, a cyclone separator 27, and a solvent recovery device 30 all of conventional design.

For circulating the liquified carbon dioxide through the machine a pump 22 is provided. The pump 22 is used to transfer liquified carbon dioxide between the storage tank 14, the solvent recovery device 30, and/or the vessel 11. Additionally, the pump 22 is used to circulate the liquified carbon dioxide through the cyclone separator 27, the vessel 11, a filter 16, and a lint trap 17. Preferably, the lint trap 17 is equipped with a removable inner basket to protect the pump 22 from large particles, for example, greater than 40 microns, while the filter 16 is provided to remove finer particles, for example, 1 to 20 microns.

During operation of the dry-cleaning machine, the basket 12 is loaded with the items to be cleaned and the vessel 11 is then charged with the liquified carbon dioxide from the storage tank 14. Charging of the vessel 11 occurs during the wash and rinse cycles. To accelerate a cleaning cycle, aid in the removal of any insoluble soils, and reduce the possibility of re-disposition of contaminants, the liquid carbon dioxide and the items to be cleaned may be agitated, such as by rotation of the basket and/or by the direction of gaseous carbon dioxide into the interior of the basket, as disclosed in commonly assigned U.S. application Ser. No. 08/998,399, filed Dec. 24, 1997. Once the wash and rinse cycles have been completed, the drying/draining cycle is commenced during which time the liquified carbon dioxide is removed from the vessel 11.

To effectively remove the contaminants from the items, the liquid carbon dioxide must be at a temperature at which the contaminants are substantially soluble. Accordingly, when liquified carbon dioxide is used, the desired pressure in the pressure vessel 11 ranges from about 700 psi (48 bar) to about 850 psi (59 bar) while the temperature ranges from about 55° F. (13° C.) to about 80° F. (24° C.). At temperatures and pressures outside those ranges, the liquified carbon dioxide may go into a supercritical fluidic state, and become too aggressive for some dry-cleaning applications. When the system is used to clean garments, it is desirable to maintain the temperature above 32° F. as any drop below this critical temperature may cause damage to the garments.

For removing contaminants from the liquid carbon dioxide during the wash and rinse cycles, the liquid carbon dioxide preferably is cycled from the vessel 11 through the solvent recovery device 30. The solvent recovery device 30 functions to vaporize the liquid carbon dioxide to separate and concentrate the particulates. During such processing, the clean gaseous carbon dioxide is directed to a condenser (not shown) where it is reliquified and then returned to the storage tank 14. Alternatively, the particulates may be removed from the liquid carbon dioxide by cooling the liquid to a point where the solvent capabilities of the liquified carbon dioxide do not allow the particulates to remain suspended, as disclosed in co-assigned application Ser. No. 08/998,392, filed Dec. 24, 1997.

It will be appreciated by one skilled in the art that during the wash and rinse cycles gaseous carbon dioxide may be released from the cleaning liquid and accumulate within the vessel. The gaseous carbon dioxide typically is evacuated from the vessel and directed to the storage tank 14 where it condenses. This evacuation typically occurs upon completion of the washing operation prior to opening the vessel to remove the cleaned items.

Figure 2:
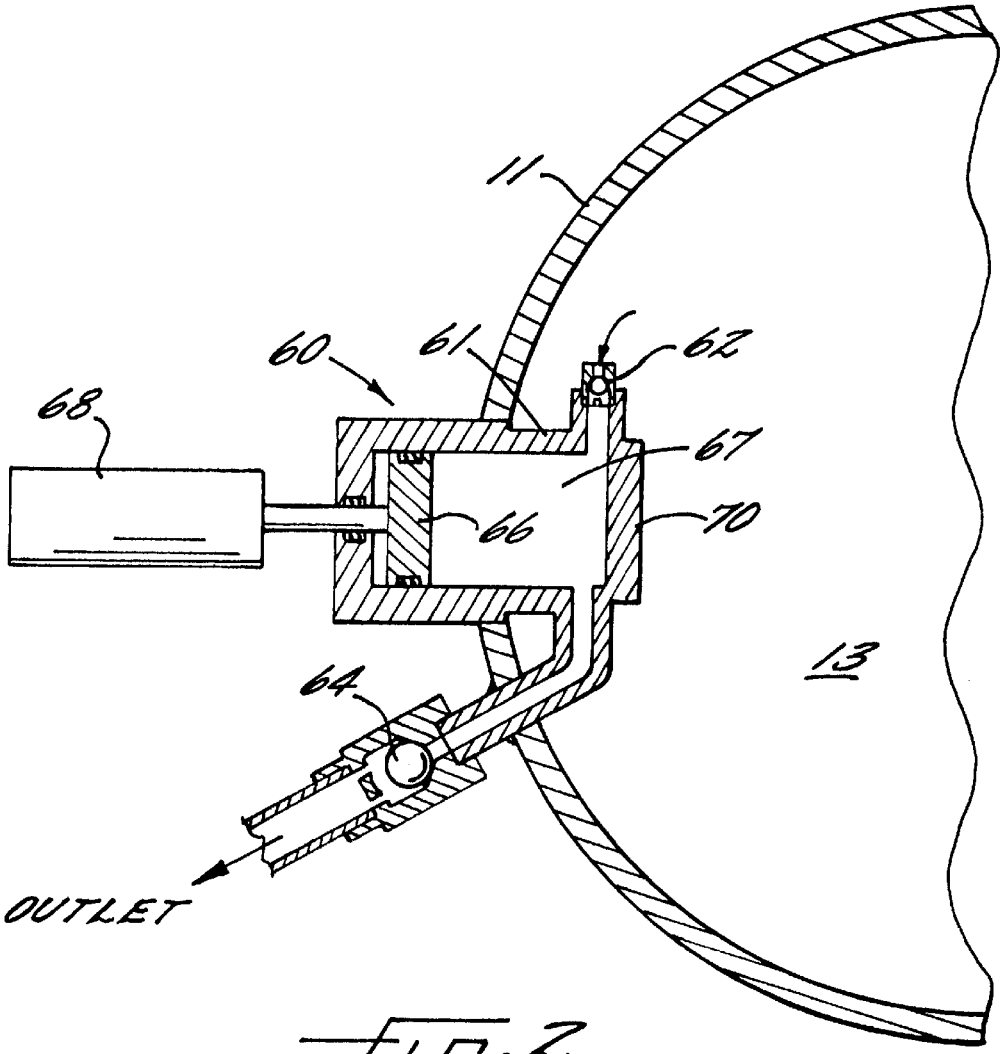
FIG. 2 is an enlarged fragmentary section of the compressor used in the dry-cleaning system illustrated in FIG. 1.

For removing gaseous carbon dioxide from the vessel 11, a compressor 60 is provided to pump gaseous carbon dioxide from the vessel 11 to the storage tank 14. As shown in FIG. 2, the compressor 60 has a head 61 which defines a compression chamber 67 within which a piston 66 is mounted for reciprocating movement. The piston is driven by a compressor drive 68 that preferably is controlled by a processor (not shown) in a conventional manner.

During operation of the compressor, movement of the piston 66 in an expansion stroke, i.e. to the left as viewed in FIG. 2, will create a vacuum in the compression chamber 67 and draw in gaseous vapor from the cleaning chamber though an inlet check valve 62. Movement of the piston 66 in the oppositely directed compressive stroke will cause the previously drawn volume of gaseous vapor to be compressed and evacuated from the compression chamber 67 via an output check valve 64 for direction to the storage tank 14.

As understood by one skilled in the art, pumping gaseous carbon dioxide from the pressure vessel 11 will reduce the internal pressure within the cleaning chamber with a resultant temperature decrease. Heretofore, auxiliary heaters have been required in order to compensate for such temperature decrease and maintain the required temperature level within the pressure chamber.

In accordance with an important aspect of the invention, the compressor is mounted in close proximity to the pressure vessel so that heat generated by the compressor during its operation may be directly utilized by the vessel for maintaining the desired temperature level within the vessel, thereby minimizing the need to use auxiliary heaters. To this end, the compressor 60 is mounted in the wall structure of the pressure vessel 11 such that at least a portion of the compressor is located within the interior of the pressure vessel cleaning chamber. In this manner, heat generated by the compressor when pumping gaseous carbon dioxide from the pressure vessel will offset the loss of heat attributable to the resulting pressure reduction. Unexpectedly, it has been found that the heat of compression generated by the compressor during the compression stroke is generally equivalent to the heat loss resulting from the pressure drop incident to evacuation of the gaseous carbon dioxide during the expansion stroke. To further ensure that sufficient offsetting heat is provided by the compressor, a heat sink 70 may be attached to the end of the compressor head 61 disposed with the interior of the pressure vessel.

It will be appreciated by one skilled in the art that mounting the compressor 60 in the wall structure of the pressure vessel in accordance with the invention allows the temperature within the cleaning chamber to remain substantially constant during the evacuation of the gaseous carbon dioxide. This eliminates or at least minimizes the need for auxiliary heating and the increased operational costs associated therewith. Mounting of the compressor further maintains the temperature of items within the pressure vessel, and in particular garments, at acceptable temperature levels which prevents temperature related damaging of the item. Mounting of the compressor within the pressure vessel further advantageously minimizes space requirements for the cleaning machine when installed in a dry-cleaning establishment.

We claim:

1. A method for minimizing effects of a temperature decrease within a pressure vessel in a liquified gas dry-cleaning system resulting from an evacuation of a gaseous form of the liquified gas from the pressure vessel, the method including the steps of:

using a compressor to evacuate the gaseous form of the liquifiable gas from the pressure vessel; and mounting the compressor in direct contacting relationship with the pressure vessel such that heat generated by the compressor during the evacuation of the gaseous form of the liquifiable gas from the pressure vessel is directed into an interior of the pressure vessel.

2. The method as recited in claim 1, wherein the step of mounting the compressor comprises mounting the compressor in the pressure vessel such that at least a portion of the compressor extends into the interior of the pressure vessel.

3. The method as recited in claim 2, further comprising the step of attaching a heat sink to a portion of the compressor within the interior of the pressure vessel.

* * * * *